United States Patent [19]

Walther

[11] Patent Number: 4,846,340

[45] Date of Patent: Jul. 11, 1989

[54] SHOCK PROOF CARRYING ENCLOSURE FOR MUSICAL INSTRUMENT

[76] Inventor: John D. Walther, 2140 Hames Rd., Aptos, Calif. 95003

[21] Appl. No.: 190,008

[22] Filed: May 4, 1988

[51] Int. Cl.[4] ..... A45C 11/00

[52] U.S. Cl. ..... 206/14; 150/162; 206/523; 206/592

[58] Field of Search ..... 150/52 E, 52 F, 52 G, 150/52 J; 206/314, 523, 592, 14

[56] References Cited

U.S. PATENT DOCUMENTS

| | | | |
|---|---|---|---|
| 4,427,113 | 1/1984 | Wanner | 206/314 |
| 4,522,303 | 6/1985 | Starr | 206/592 X |
| 4,657,135 | 4/1987 | Kjose | 150/52 E |

FOREIGN PATENT DOCUMENTS

| | | | |
|---|---|---|---|
| 1210324 | 3/1960 | France | 206/523 |
| 1451468 | 7/1966 | France | 206/314 |
| 2280301 | 2/1976 | France | 206/523 |
| 2086353 | 5/1982 | United Kingdom | 206/523 |
| 2169586 | 7/1986 | United Kingdom | 206/314 |

*Primary Examiner*—William Price

*Attorney, Agent, or Firm*—Owen, Wickersham & Erickson

[57] ABSTRACT

A shock proof carrying and storage enclosure for a cello retained within a conventional rigid case is disclosed. The enclosure comprises a series of pad members of yieldable material which are shaped and fitted to completely surround the rigid case. The pad members are in turn completely surrounded by and firmly held together against the outer surfaces of the rigid case by an outer cover to provide shock protection which enables the enclosure to be transported safely within a cargo compartment of an aircraft or the like.

5 Claims, 2 Drawing Sheets

SHOCK PROOF CARRYING ENCLOSURE FOR MUSICAL INSTRUMENT

This invention relates to a protective enclosure for large musical instruments, and more particularly to a shock proof carrying enclosure for a cello within its conventional hard case.

BACKGROUND OF THE INVENTION

Many musicians such as cellists find it necessary to travel by air in order to accommodate engagements at different locations required for an active concert schedule. For cellists in particular, air travel presents a unique problem with regard to the protection of their valuable instrument. Existing airline policy requires cellists to either pay for an expensive seat for their instrument or to check it on the airplane as fragile cargo. Prior to the present invention, the latter alternative was not practical, because even the more advanced "hard" cello cases failed to provide adequate shock protection for the instrument in a cargo facility. Cellos, like most stringed instruments are characteristically fragile as well as being expensive to repair or replace. The conventional hard case affords only minimal protection against exterior impinging shock forces or blows against it. A direct force transmitted to an outer hard case has a significant probability of distrupting or damaging the cello inside or of at least affecting its sound quality when subsequently used. Thus, the traveling cellist, to insure the safety of his instrument was heretofore obliged to buy an extra airline seat for his instrument to insure its protection.

It is therefore one object of the invention to solve the aforesaid problem by providing a shock-proof enclosure for a cello that enables it to be placed in a cargo section of an airliner with the assurance that the cello will be more fully protected from any damage due to extraneous shock forces.

Another object of the invention is to provide a shock proof enclosure for a cello within its conventional case that is relatively light and easy to carry.

Still another object of the invention is to provide a shock proof carrying or storage enclosure for a cello that is easy to assemble, open and close, and also highly durable.

SUMMARY OF THE INVENTION

In accordance with the principles of the invention an enclosure is provided for surrounding and supporting a conventional hard case which contains a cello. The enclosure comprises a series of resilient pad-like components, each of which includes a body of resilient, cellular material enclosed within a flexible covering. A first such pad-like component comprises a peripheral wall member that wraps around the sidewalls of the hard cello case. The ends of this wall member are interconnected by a back pad member which fits against the base of the hard case. This first wall member also fits around a bottom and a top pad member which are both shaped to conform with the general plan form of the hard case and are adapted to lie adjacent to the bottom and top sides respectfully of the hard case. Thus, when assembled, the four pad members completely surround the hard cello case. Surrounding the pad members themselves and holding them together is an outer cover of relatively heavy but flexible cloth or woven material having a flap portion with a conventional zipper or suitable fasteners which provides access to the enclosure. When assembled within the case, the cello inside the enclosure can be conveniently carried and then stored in cargo space while being fully protected.

Other objects, advantages and features of the invention will become apparent from the following description of one embodiment thereof, presented in conjunction with the accompanying drawing.

DETAILED DESCRIPTION OF EMBODIMENT

Figure 1:
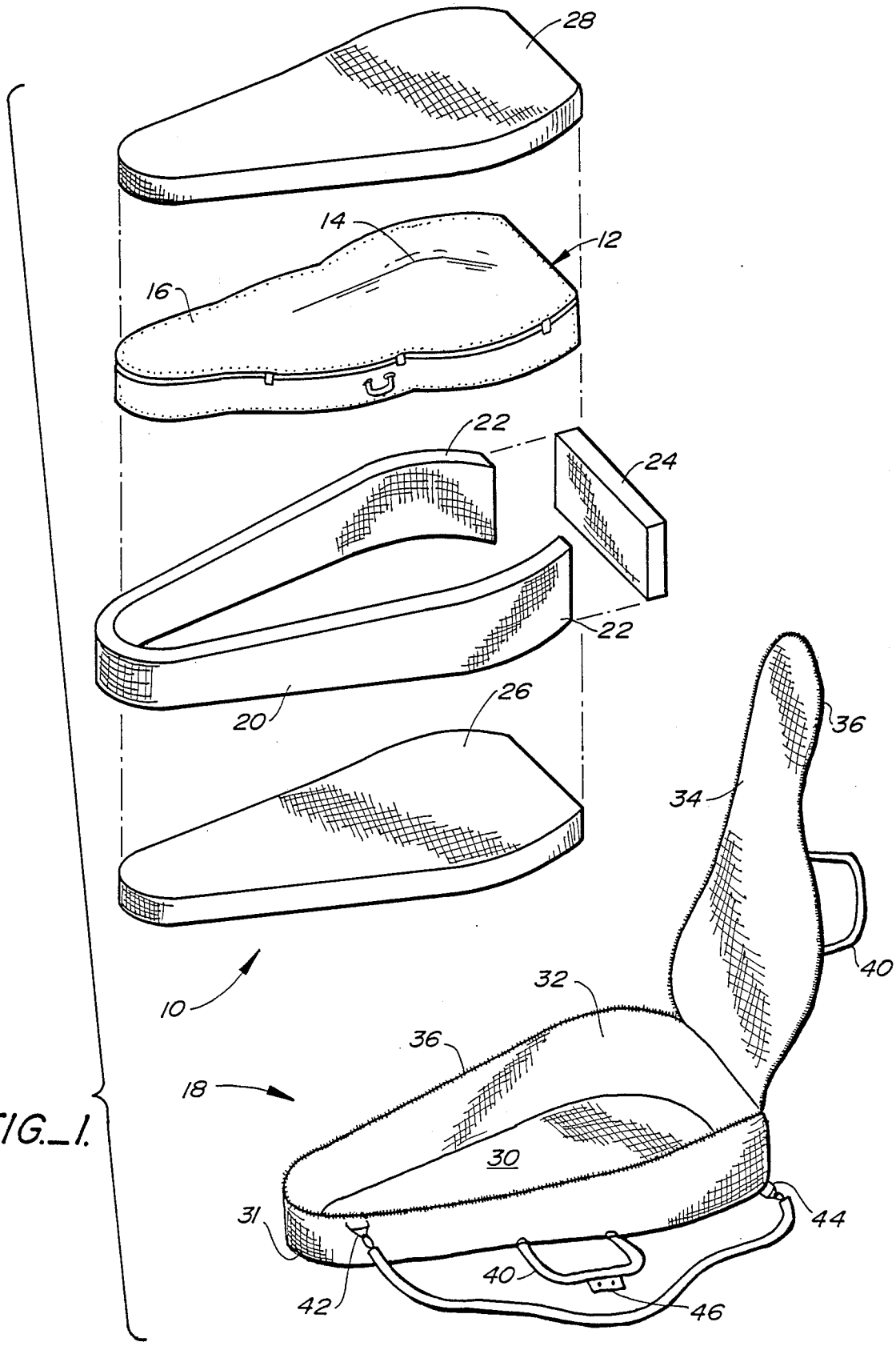
FIG. 1 is an exploded view in perspective showing the components for the protective enclosure according to the present invention.
Figure 2:
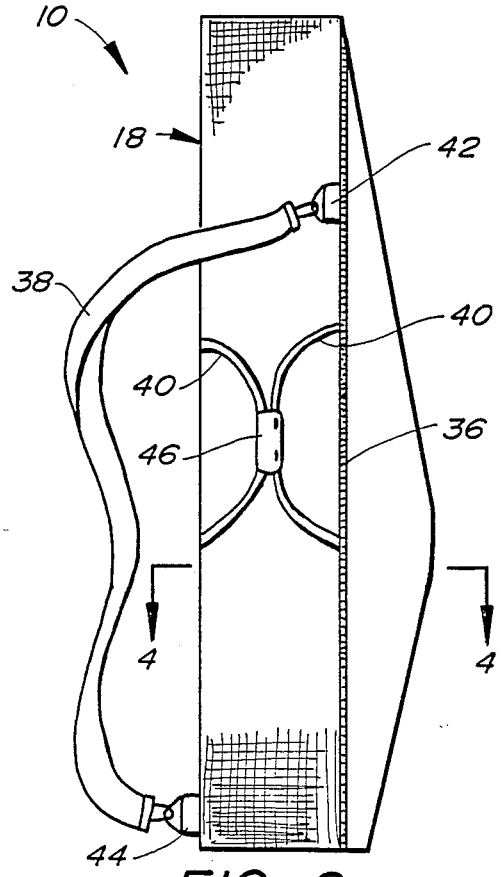
FIG. 2 is a view in side elevation of the closed assembled enclosure shown in FIG. 1.

With reference to the drawing, FIG. 1 shows a shock-absorbing protective enclosure 10 embodying principles of the present invention as it appears in an exploded view with all of its components separated. In FIG. 2, the same protective enclosure is shown in its assembled form and closed so that it can be readily carried and then stored, for example, in the cargo compartment of an airliner.

As shown in FIG. 1, the enclosure 10 is shaped to accommodate a rigid or hard case 12 for a cello instrument or the like. Such a case has the conventional pear-shaped configuration for a stringed instrument, that is, a relatively wide base portion 14 that tapers to a narrower section 16 at one end.

Figure 4:
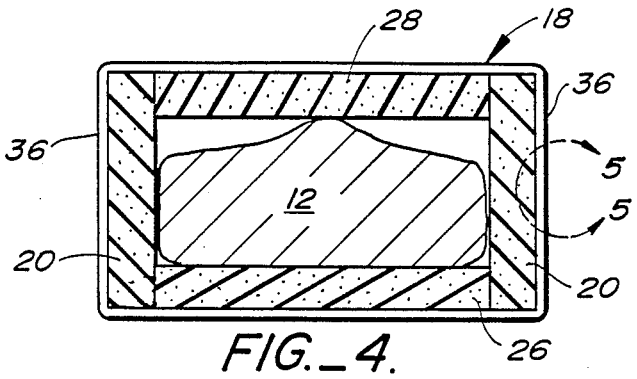
FIG. 4 is a view in section taken along line 4–4 of FIG. 3.
Figure 3:
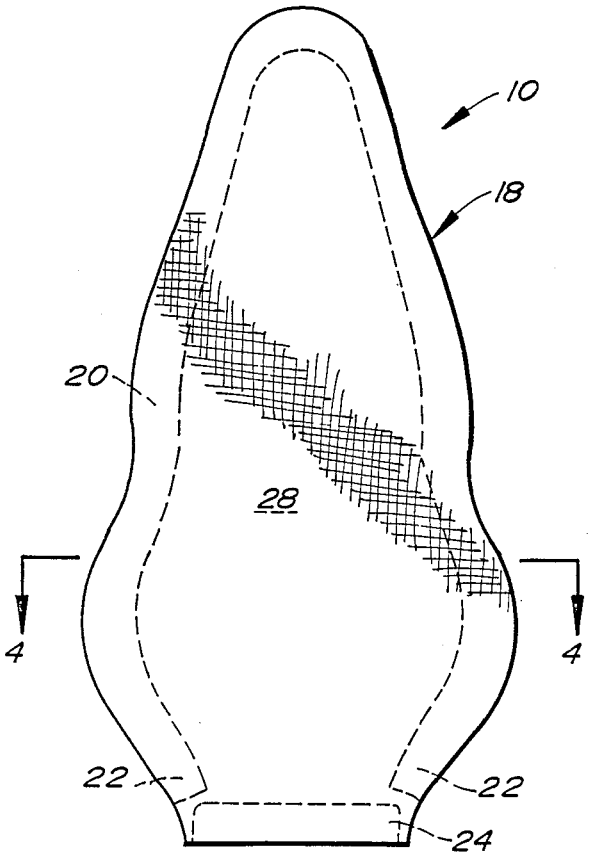
FIG. 3 is a plan view of the enclosure shown in FIG. 2.

The cello (not shown) within the hard case is usually restrained in some suitable manner to prevent its movement therein. Although the case interior may be lined with a soft material the cello would still be vulnerable to damage resulting from shock forces applied directly to the hard case. In accordance with the invention, the enclosure 10 comprises generally a series of flexible pad-like components that surround the case 12 and are held together by an outer cover member 18. A first and largest pad-like component 20 comprises an elongated wall member that is bent in generally a V-shape to extend around the narrow end 16 of the case 12 and along the sides thereof. To conform with the general shape of the case 12, the component 20 is shaped so that an intermediate portion 21 which curves around the narrow end 16 of the case is somewhat narrower in width than its end portions 22. When installed in the enclosure, the end portion 22 of the pad member 20 are adjacent the opposite ends of a second or end wall pad member 24. The latter end wall member has the same height as the end portions 22 of wall member 20 and lies adjacent the end surface of the base portion 14 for the case 12. Thus, together the wall members 20 and 24 form a continuous outer barrier around the entire irregular sidewall of the case 12. To cover the top and bottom sides of the case, a bottom pad component 26 and a top pad component 28 are provided. As shown, these bottom and top pads are shaped in a configuration similar to the planform of the hard case 12 and they fit within the inside dimensions of the wall member pads 20 and 24. Thus, as indicated by FIGS. 3 and 4, the pad-like components completely surround the hard case 12.

Figure 5:
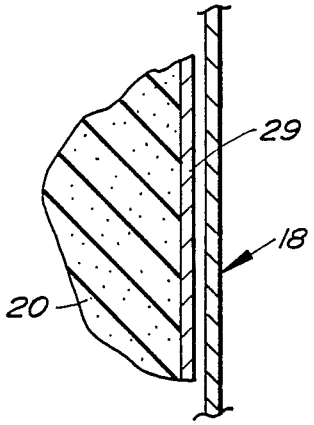
FIG. 5 is an enlarged view in section taken at line 5—5 of FIG. 4.

All of the pad members are made of a suitable foam rubber or foam plastic material that is resiliently flexible and has a uniform thickness, (e.g. 3 inches). Also, as shown in FIG. 5, each pad member is covered by and enclosed within a thin, flexible but durable synthetic material 29 such as a nylon fabric or the like. The cover material for each pad is preferably cut and sewed together to form a snug, fairly tight pad enclosure that protects the foamed material from excessive wear.

The outer cover 18 which surrounds the pad member and holds them firmly against the cello case 12 is made of a flexible but heavier material (e.g. 200 D Oxford Cloth) and has generally the same cello case configuration. The outer cover 18 has a bottom section 30 which is connected, as by stitching along a continuous seam 31, to the lower edge of a peripheral side wall section 32. An upper flap portion 34 is connected to the cover side wall section 32 by a zipper 36 just below the top edge of the wall members 20 and 24. The zipper extends from near the opposite ends of the end pad 24 around the small end of the enclosure, so that the upper flap portion 34 remains integral with or attached to the side wall section of the cover along a seam 37 at one end.

The protective pads and outer cover 18 add only a small amount of additional weight to the hard case 12 so that the enclosure 10 can be readily hand carried. To facilitate easy carrying, a flexible strap 38 and a handle 40 are provided, as shown in FIG. 2. The strap is connected to an anchor ring 42 at one end near the zipper 36, preferably located at a short distance from the small end of the enclosure. The other end of the strap is connected to an anchor ring 44 located near the large end of the enclosure preferably above the seam between the bottom portion and the sidewall portion of the outer cover. The strap may be made of any suitable belting material and is provided with conventional hardware clips at its ends so that it can be easily removed from its end anchors. The handle 40, as shown, may also be in the form of a pair of short straps made by belting material that extends across and is anchored in a sidewall portion of the outer cover near a mid-point between its ends. The short straps are preferably held together by a grip member 46 in the well known manner.

When assembled for use, the wall member pads 20 and 24 are first placed within the cover 18 with their ends connected. The bottom pad 26 is then placed within the cover to spread the sides of the wall pad 20 apart and hold them generally in the proper position. At this point, a bed-like cavity has been formed for the hard case 12 which can be placed therein. Following this, the top pad 28 can be placed on the upper surface of the case and the upper flap portion 34 of the cover can be closed by the zipper 36. The cover is deliberately sized so as to partially compress the pad members and hold them all firmly against the case 12 when the zipper is closed. Although, the bottom of the enclosure is essentially flat, the upper surface formed by the flap portion 34 may bulge outwardly somewhat to conform with the general shape of the hard case within. Thus, in storage or when being transported, the case 12 is held firmly while being fully surrounded by shock absorbing material, and therefore the cello inside is fully protected from even slight damage due to extraneous shock forces.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A shock proof carrying and storage enclosure for a conventional rigid cello case having a general pear shape with a peripheral side wall and an end wall at its widest end extending between top and bottom surfaces, said enclosure comprising:

a series of flexible, shock-cushioning pad members of yieldable material which are shaped to fit together and completely cover said surfaces and said walls of said rigid case; and a flexible cover completely surrounding said pad members and sized to hold them together with said yieldable material in a slightly compressed state and firmly against the outer surfaces of said rigid case.

2. The enclosure as described in claim 1 wherein said pad members comprise:

an elongated side wall pad member adapted to extend around and adjacent to the peripheral side wall of said rigid case;

an end pad member adapted to extend between the ends of said side wall pad member and adjacent said end wall;

a top pad member and a bottom pad member both having substantially the same plan form shape as said rigid case and adapted to bear against its top and bottom surfaces, respectively.

3. The enclosure as described in claim 2 wherein each of said pad member comprises a block of flexible, compressible cellular foam material covered by a fabric material.

4. The enclosure as described in claim 2 wherein said flexible cover comprises a fabric material having a lower body portion that covers the outer surface of said bottom pad member and including a sidewall portion fixed to said lower body portion that substantially covers the outer surface of said side wall pad member;

a top flap portion that covers the outer surface of said top pad member; and means for connecting said top flap portion to said lower body portion.

5. The enclosure as described in claim 4 wherein said means for connecting said top flap portion to said lower body portion of said outer cover comprises a zipper member which extends around the outer surface and from end to end of said side wall pad member when said outer cover is closed.

* * * * *